United States Patent [19]

Michelberger

[11] Patent Number: 5,020,458

[45] Date of Patent: Jun. 4, 1991

[54] SEWING MACHINE, PARTICULARLY FOR EDGING OR HEMMING MATERIALS

[75] Inventor: Stefan Michelberger, Weikersheim, Fed. Rep. of Germany

[73] Assignee: Maximilian Janser, Fed. Rep. of Germany

[21] Appl. No.: 461,500

[22] Filed: Jan. 5, 1990

[30] Foreign Application Priority Data

Jan. 5, 1989 [DE] Fed. Rep. of Germany ..... 3900209

[51] Int. Cl.[5] ..... D05B 23/00

[52] U.S. Cl. ..... 112/7; 112/162; 112/302

[58] Field of Search ..... 112/7, 9, 80.7, 81, 112/102, 141, 162, 177, 178, 225, 227, 295, 269.1, 254, 302

[56] References Cited

U.S. PATENT DOCUMENTS

| | | | |
|---|---|---|---|
| 600,502 | 3/1898 | Allen | 112/7 |
| 1,587,957 | 6/1926 | Hüber | 112/162 |
| 2,023,316 | 12/1935 | Ebert | 112/162 |
| 2,065,413 | 12/1936 | Zimmermann | 112/7 |
| 2,547,821 | 4/1951 | Hartwell | 112/7 |
| 2,575,327 | 11/1951 | Ashley | 112/7 |
| 2,691,951 | 10/1954 | Hansen | 112/302 |
| 2,767,671 | 10/1956 | Shapiro | 112/225 |
| 3,079,879 | 3/1963 | Sigoda | 112/162 |
| 3,457,884 | 7/1969 | Weaver | 112/7 |
| 3,943,864 | 3/1976 | Feighery | 112/7 |
| 4,062,307 | 12/1977 | Michelberger | 112/7 |

FOREIGN PATENT DOCUMENTS 2500461 8/1979 Fed. Rep. of Germany .

*Primary Examiner*—Werner H. Schroeder
*Assistant Examiner*—Ismael Izaguirre
*Attorney, Agent, or Firm*—Sughrue, Mion, Zinn, Macpeak & Seas

[57] ABSTRACT

The sewing machine is used for looping or linking floor coverings and is transportable, so that, apart from being used in stationary manner, it can also be moved along the material edge to be looped. It produces a two-thread overcast seam and has a cutting device with a knife (108) for rounding the material corners prior to looping and is automatically started up under the control of a photoelectric cell (117) on approaching a corner.

18 Claims, 7 Drawing Sheets

SEWING MACHINE, PARTICULARLY FOR EDGING OR HEMMING MATERIALS

FIELD OF THE INVENTION

The invention relates to a sewing machine, particularly for edging or hemming materials, such as the edges of floor coverings and the like.

BACKGROUND OF THE INVENTION

The task of such linking, looping or hemming machines is in particular to cleanly and durably link or loop the edges of carpets or the like in the form of a roll product and which are cut to the use size. The aim of the invention is that despite the relatively high capacity of the machine, it can be easily handled and can also be used in a mobile manner, because in particular when looping very large surfaces the space required for moving the complete material portion passed the machine would be excessive.

The machine according to the invention has a drive, a sewing mechanism with means for conveying the material relative to the sewing mechanism, a needle mechanism and a loop forming mechanism, as well as a thread feed to the needle and loop forming mechanisms.

According to one feature of the invention the sewing mechanism preferably constructed for forming a two-thread overlock or overcast seam has a retaining gripper, which holds back a thread loop during the formation of an overlock or overcast loop. It preferably engages close to the needle movement path from below into the thread coming out of a yarn gripper.

U.S. Pat. No. 4,062,307 discloses a sewing machine producing a single-thread overcast seam. It uses a yarn gripper gripping in a loop the thread passed through the material with the needle and is passed around the edge for the next needle perforation in said loop. This machine operates in a completely satisfactory manner and can also loop thick carpets with a limited constructional size and high capacity. However, relatively large thread lengths must be drawn at high speed through the needle hole, because the entire thread supply or feed takes place from above via the needle. As the thread for looping normally consists of a relatively slightly turned thick and bulky yarn, in the case of floor coverings with a very rigid and firm back working with great care is necessary, so that the yarn does not unravel and tear during the drawing through the hole.

SUMMARY OF THE INVENTION

However, in the case of two-thread overcast seams a thread passes through the holes made, which only has a retaining function and no significant decorative or covering function. It is possible then to use a very firm, thin, high quality thread, e.g. a twist. Thus, this thread is subsequently referred to as the twist, whilst the term yarn is given to the thread which passes from the top to the bottom row of stitches around the outer edge and optionally an intermediate band or ribbon and which has the actual covering and decorative function. It is also advantageously possible to use as the yarn two yarn threads taken from different bobbins, in order e.g. to better obtain the carpet colour in the looping by mixing two yarn colours. Thus, hereinafter "yarn" also refers to several threads.

At the sewing mechanism the twist is inserted by the needle forming loops with a yarn threaded in a yarn gripper on the top and bottom of the material. An overcast gripper takes over the thread coming from the yarn gripper and at the top brings it in the form of a loop around the material edge.

As a function of the thread tensions or roughnesses and other conditions the yarn can draw the twist loop formed on the underside towards the material edge, whilst the overcast gripper draws yarn for forming the long overcast loop. Therefore a retaining gripper engages in the yarn loop part left on the material underside and retains it for as long as the overcast gripper draws the loop around and upwards. The retaining gripper is then drawn out and the twist loop can draw tight the yarn until the lower weave formed by the yarn is located directly at the stitch row and is not displaced towards the edge. This makes it possible to reduce the twist tension, because the twist does not have to any longer actively oppose this displacement tendency.

The three grippers can all be in the form of oscillating grippers and can be mainly harmonically and continuously moved, which is possible through simple crank, eccentric or lever movements. Sliding movements and other movements are unfavorable as regards to production and wear can be largely avoided. Only the retaining gripper normally has a stoppage phase, but this can be derived from a lever movement by a simple stop. The grippers are constructed in such a way that their overall size is small compared with the paths covered by them and permits their concentration in a small space. It is advantageously possible to make as flat as possible the base part receiving the grippers, i.e. the space located below the material reception table, so that the carpet only has to be raised slightly in the case of an apparatus movable on the ground or floor by means of partly self-guiding rollers or runners, so that the sewing machine runs along the edge of the carpet during looping or linking.

Nevertheless it is still possible to thread the yarn in the yarn gripper at the bottom through a threading mechanism. A thread guide channel through which the yarn enters issues in a position in which the yarn gripper assumes a clearly defined position, e.g. marked on the handwheel, e.g. the bottom dead centre of the sewing mechanism. With it is aligned a threading channel which, like the thread guide channel, terminates outside the machine, so that it is possible to pass through these two channels and the intermediate eye or eyelet a threading tool, e.g. in the form of a wire with a hook and on it a yarn can be drawn through.

According to another feature of the invention a sewing machine of the aforementioned type can have a cutting device for the material enabling the normally rectangular corners obtained to be provided with a suitable radius for looping. Upstream of the needle position is provided for this purpose a vertically oscillating knife, whose cutting position is aligned with the edge. A continuous drive of this knife would admittedly not directly damage a carpet blank, because it would only "scrape along" the edge, but it would be unfavorable from the wear, noise level and similar standpoints. Thus, according to this feature of the invention the knife drive can be switched on and off by a knife switching mechanism during the operation of the sewing mechanism. The knife switching mechanism is preferably automatically operable as a function of the material, e.g. by means of a photoelectric cell, which puts the cutting mechanism automatically into operation when a corner arrives, i.e. if the photoelectric cell positioned upstream of the needle position obtains light from a lamp provided on the machine, whilst normally it is covered during the looping of straight edges of the carpet.

In order to be able to advantageously derive the knife drive from the main drive, the knife drive, which can e.g. be a double-sided cam, which advantageously permits two knife strokes per stitch, can constantly function, whereas the actual knife drive member, e.g. a lever cooperating therewith can be kept in the normal position out of engagement with the drive by a notch retainer operated by a magnet.

As rotation relative to the machine is necessary for cutting the carpet, but when looping straight surfaces it is important to have a precise and powerful fixing of the material to ensure a precise and effective conveying, according to the invention the conveying means are relieved on cornering. Conventionally such a relief is provided manually by means of a raising lever for the pressure foot, which presses the material against a conveying serrated slat movable in oscillating manner and located in the base part. Such a raising device is also provided. Additionally relieving means are provided, which on connecting in the cutting mechanism relieve the pressing of the pressure foot on the conveying serrated slat of the spring tension normally acting thereon. It is particularly preferred to have a construction in which this takes place by a clamping mechanism acting in one direction and operable by the switching device and which only permits an upward movement of the pressure foot when the latter is operated, but prevents any downward movement. Thus, the pressure foot, which is normally raised somewhat and then lowered again by the raising movement of the conveying serrated slat during each stroke is prevented from travelling downwards again under the spring tension, so that it remains in the top position of this cycle dependent on the material thickness. Thus, in this position and accompanied by automatic adaptation to the material thickness a rotation of the covering is easily possible without damaging the carpet and relative thereto without losing the necessary contact pressure for a certain conveying support and guidance.

It is also possible to provide a guide stop, which normally guides the material edge, but which can be swung away from inner corners for looping. On it can preferably be provided an inlet roll, which runs upstream of the material guide stitch edge and is so inclined that it moves the material towards the guide stop. This is particularly important if only narrow strips, e.g. as floor selvedges are to be looped.

The invention also relates to a sewing machine in which the thread feed contains at least one thread tightener, which guides the thread between two surfaces. One can be a roll rotatable with the thread, which is pressed by an e.g. sheet metal bent pressing part. It has been found that as a result of this arrangement it is possible to avoid the formation of thread kinks resulting from the overtwisting or undertwisting of the thread or, if they have already formed, can pass through without causing any problem and will also lead to no difficulties in the further processing sequence. Such a kink formation can e.g. be due to the removal of threads from one end face of a bobbin, which applies a 360° twist to the thread during each turn. By applying a yarn eyelet to the pressing part it can be self-regulating, i.e. in the case of high thread feed tension the pressing part, which is pressed in a resiliently adjustable manner, is raised and consequently reduces the tension otherwise applied by it. If this eyelet is located on the inlet side of the thread tightener, then the latter reacts to resistances in the upstream thread feed, uninfluenced by the thread discontinuously drawn from the sewing mechanism.

The invention also relates to a feature according to which the thread feed is so constructed that a thread looping from the outside an eyelet following thread loosening can no longer be squeezed, which has previously usually led to a thread break. If namely the eyelet is constructed in such a way that the connection thereof to a machine part in the vicinity of the eyelet is no narrower than the eyelet outer boundary, then the thread automatically slips down on it if it is placed under tension, without being fixed by the squeezing of two superimposed thread parts.

The invention leads to a sewing machine for hemming or looping which, despite a high capacity and the possibility of working floor coverings of random thickness, is transportable and usable under rough building site conditions, whilst still being very reliable. For transportation purposes the part receiving the thread bobbin or intermediate ribbon rolls can be flipped up. It can also have furniture-like casters, whilst in the sewing area can be provided a fixed roll running in the sewing direction.

These and further features of preferred developments of the invention can be gathered from the claims and drawings and the individual features, either alone or in the form of subcombinations, can be realized in an embodiment of the invention and in other fields and can represent advantageous, independently protectible constructions for which protection is hereby claimed. The invention is described in greater detail hereinafter relative to non-limitative embodiments and the attached drawings.

DESCRIPTION OF THE PREFERRED EMBODIMENT

Figure 1:
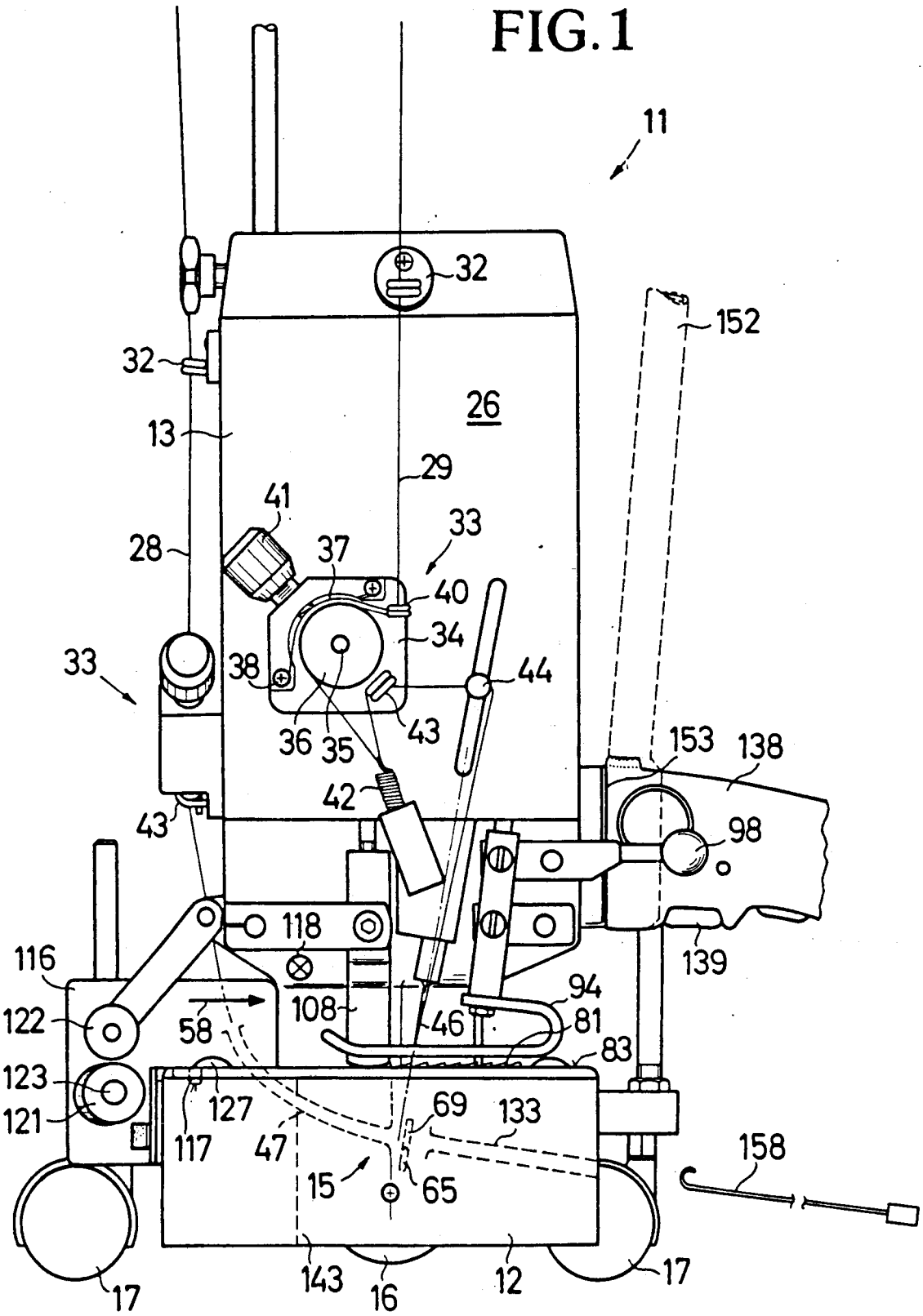
FIG. 1 a front view of a sewing machine.

The sewing machine 11 shown in the drawings has a lower, relatively flat base part 12 and a tower or column-like drive part 13 projecting upwards from the same (FIGS. 1 and 2), which comprises the drive motor 14 (FIG. 3) and the essential drive mechanisms. On the base part a runner 16 is located somewhat below the sewing mechanism 15, whilst two further, self-guiding rollers 17 are located under a support disk 19 which can be folded out and locked by means of a lever 18, on which is located mounting supports 20 for two yarn bobbins 21 and which receives a supply roll 22 of an intermediate ribbon 23. A mounting support 24 for a twist bobbin 25 is provided on the removable drive part casing 26, which is provided with a handle 27 for transportation purposes. The yarn 28 and twist 29 coming from the corresponding bobbins 21, 25 passes via subsequently described eyelets 30 to a pivotable or removable thread unwinding frame 31, which is flexible for tension compensation purposes and is then supplied from above via eyelets 32 to in each case one thread tightener 33, which are also fitted to the casing 26.

Figure 2:
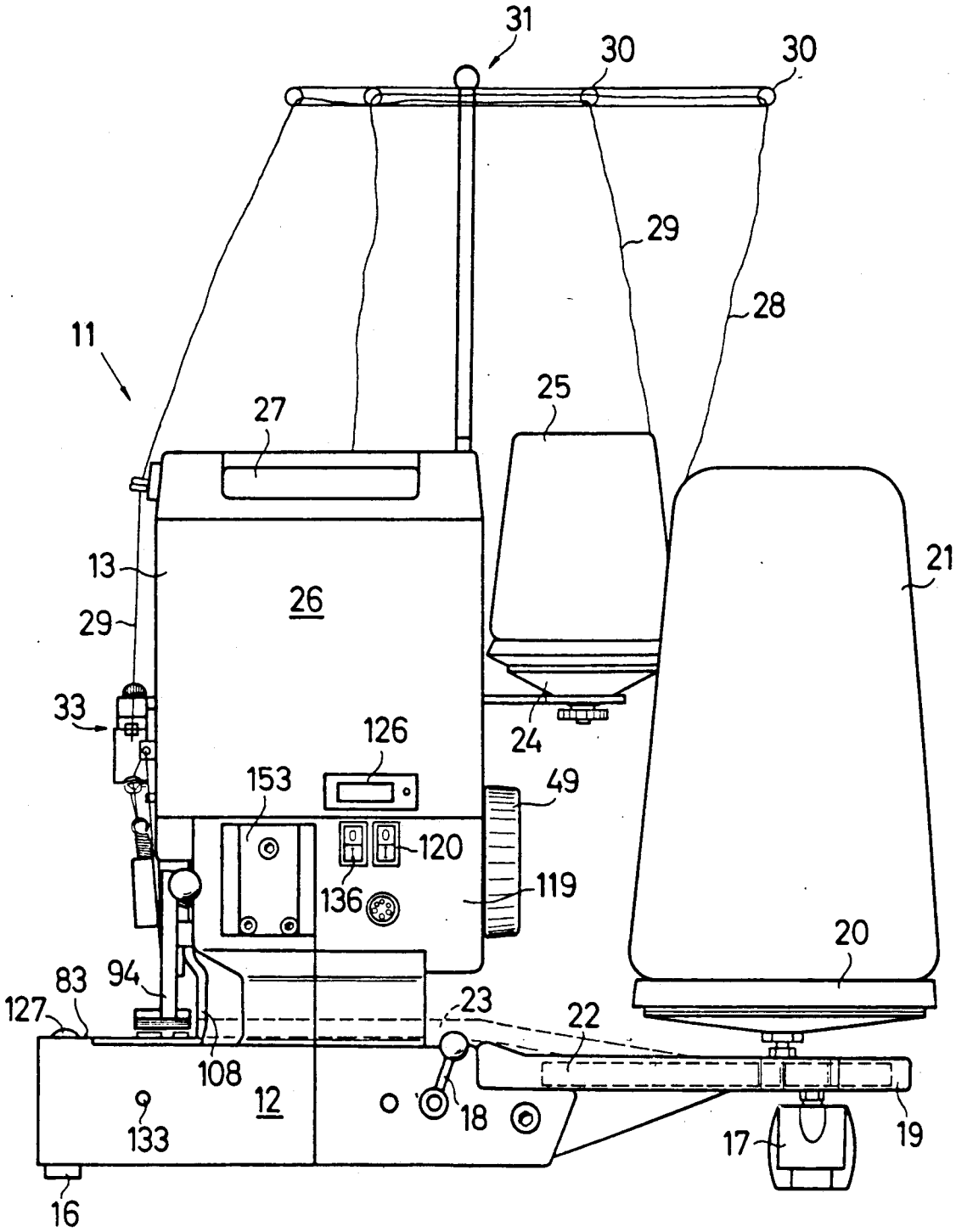
FIG. 2 a side view.

Each thread tightener 33 contains a base plate 34 on which a roller 36 is mounted so as to rotate about a horizontal shaft 35 (FIG. 1). A pressing part 37 bent from spring steel sheeting and pivotable about a shaft 38 engages flat on the circumferential surface 39 by an angle of approximately 90° or higher. On the end of the pressing part facing the shaft is provided a guide eyelet 40 for thread 28 or 29. The thread part 37 is so pressed on the roller by an adjusting screw and a spring guided therein that the thread is pressed flat between them. As roller 36 can also rotate on drawing through the thread, in the case of a comparable tensioning or braking action of the thread tightener the pressing force of part 37 can be relatively high. Together with the flat engagement, as a result of the thread twist, thread kinks which have been produced beforehand or in the thread tightener can be avoided or passed through. An arresting effect which has occurred in the thread running direction upstream of the thread tightener 33 leads to a pressure reduction of pressing part 37 through an upwardly directed pull on eyelet 40, so that there is an automatic tension check or regulation.

Figure 3:
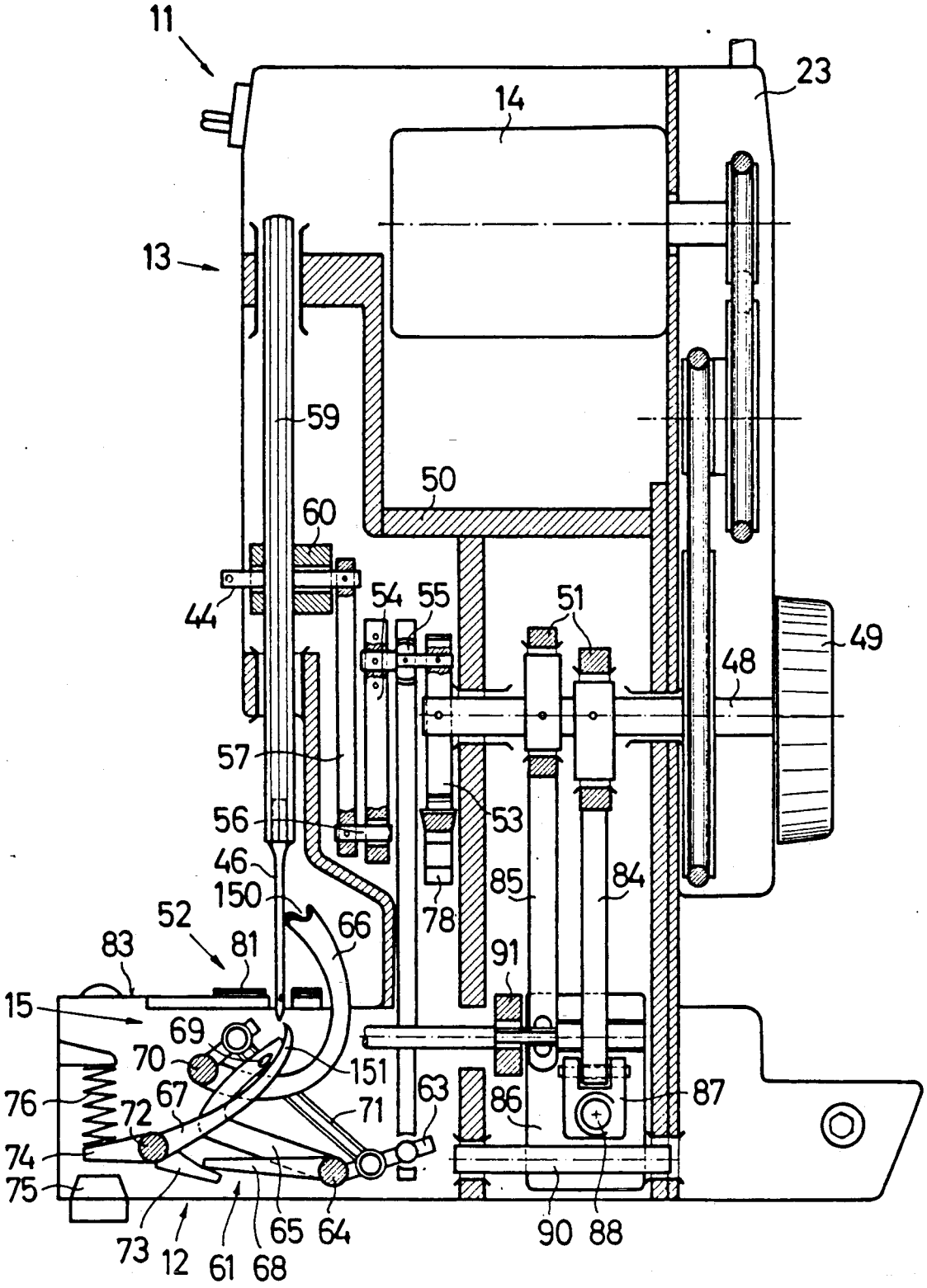
FIG. 3 a diagrammatic partial section of the side view.

After looping roller 36 by 130° to 180° by means of a tension compensating spring 42 and an eyelet 43, the twist 29 passes to a thread raiser 44 driven in oscillating manner together with the needle and relieves the eye 45 in needle 46 from the thread drawing off (FIG. 3).

An identical thread tightener is provided for yarn 28 (FIG. 1) and, after roller 36, passes directly through the eyelet 43 to a yarn guide channel 47 in the form of a bent pipe through which it passes to the sewing mechanism 15.

Figure 8:
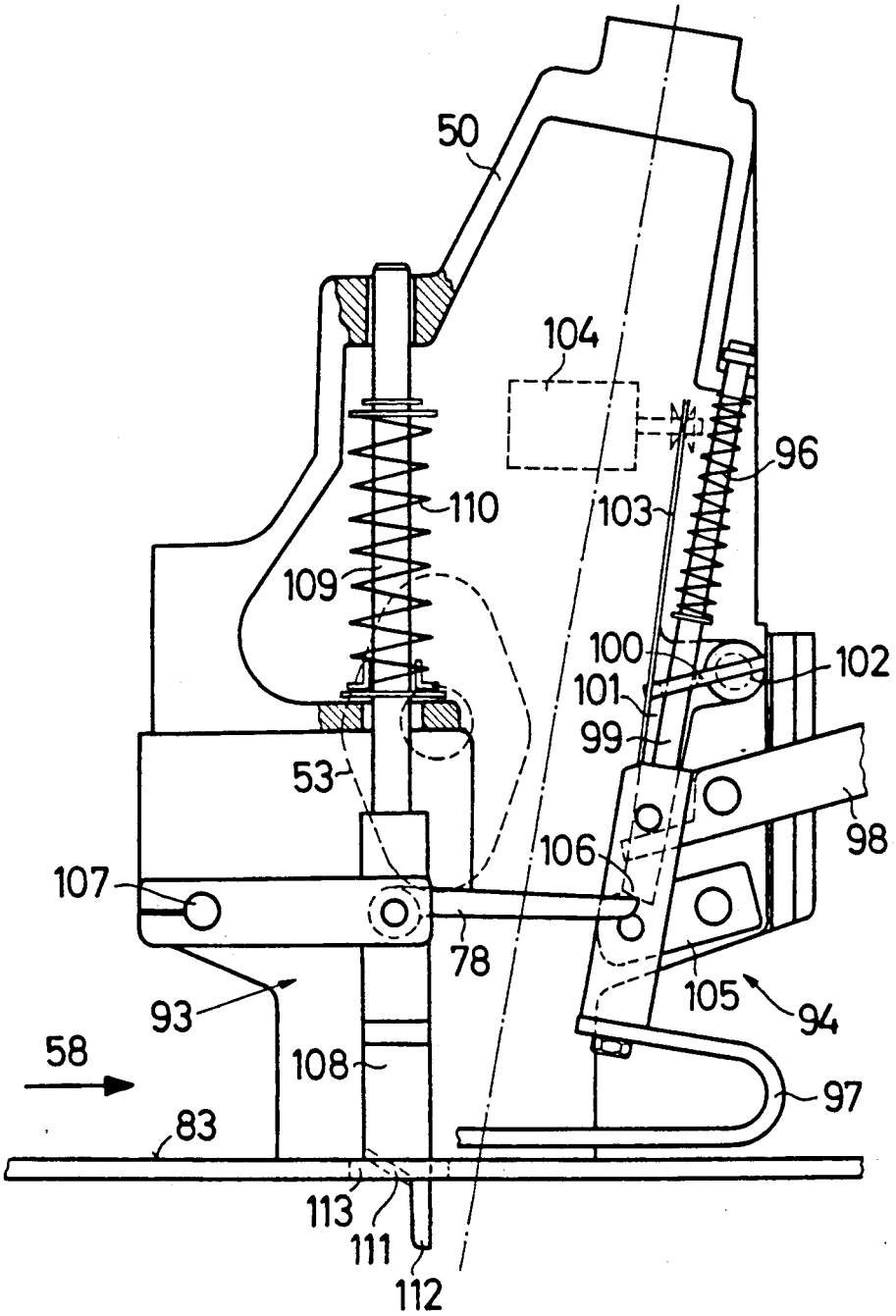
FIG. 8 a diagrammatic partial front view with cover removed showing the cutting device and the pressure foot relief.

Sewing machine 11 is driven from a main shaft 48 (FIG. 3), which is driven by motor 14 via a suitable drive, in this case a two-stage round belt reduction gear. A handwheel 29 on main shaft 48 located outside casing 26 permits a fine setting, e.g. for threading purposes. On the main shaft 48 mounted in a base frame 50 are provided two eccentrics 51 for driving the material conveying means 52. On the end of main shaft 48 opposite to handwheel 49 is fitted a crank gear, which comprises two disk-like crank webs 53, 54, a crank pin 55 connecting them and a freely projecting crank pin 56. The inner crank web 53 is constructed as a drive cam of a cutting device with two facing cam protuberances on the circumference (FIG. 8). By means of a connecting rod 57, the crank pin 56 actuates the drive of the longitudinally slidingly guided needle bar 59 slightly rearwardly inclined with respect to the material running direction. Connecting rod 57 acts on the same by means of a clamping block 60 clamped to the needle bar 59 and which also carries the thread raiser 44 projecting outwards through a slot in casing 26. The loop forming mechanism 61 arranged in base part 12 and which will be described relative to FIGS. 3 to 6, is driven by the crank pin 55 via connecting rod 62. Via a drive lever 63, it oscillates a shaft 64 to which are fitted in non-rotary manner a yarn gripper 65 and an operating lever 68.

The yarn gripper 65 has an arcuate or ring segmental shape in its outer portion, which carries a yarn eyelet 69 close to its front end and is connected via a radial arm to shaft 64.

An overcast gripper 66 is pivotably mounted about a shaft 70 and is driven by lever 63 via a thrust rod 71. It has an arcuate shape and to its one end is fixed the shaft 70, whilst the other end is provided with a gripper fork 150.

A retaining gripper 67 with a retaining finger 151 is pivotable at its front end about a shaft 72 and is driven by lever 68 via a lever arm 73. A stop lever 74 cooperates with a casing stop 75 against which it is pressed under the tension of a spring 76 for limiting the movement of the retaining gripper 67.

The conveying means 52 for the material 80 to be looped or linked (FIG. 9) contain a conveying serrated slat 81, which covers an oval movement path 82 as indicated in dot-dash line manner in FIG. 9, so that a conveying stroke in which the serrated slat is moved over the plane of the material support table 83 in the conveying direction 58 is followed by a return stroke into a position lowered below plane 83. This is brought about by the connecting rods 84, 85 connected to eccentrics 51. The connecting rod 84 pivots a lever 86, in that it is articulated to a threaded bush 87, which is displaceable by means of an adjusting knob 89 on an adjusting threaded rod 88 provided with a very steep external thread. The lever pivots about the axis 90, whilst to its other end is articulated a lever 91, which carries at its other end the conveying serrated slat 81. At a distance from articulation 92 connecting rod 85 engages on lever 86.

Figure 9:
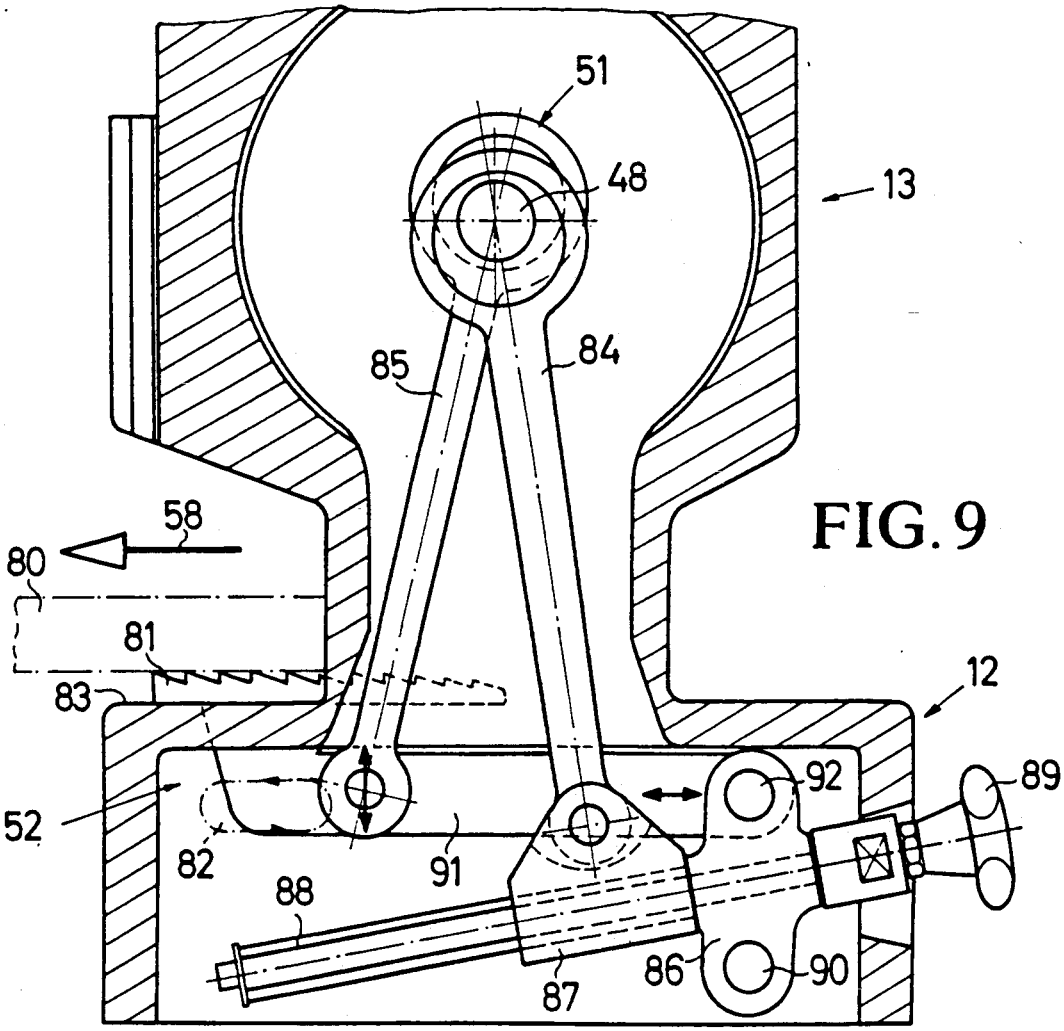
FIG. 9 the serrated slat drive.

On rotating the main shaft 48, through the connecting rod 84 the threaded rod 88 and the connected lever 86 is reciprocated in the manner indicated in FIG. 9. Thus, lever 91 and therefore the conveying serrated slat 81 a substantially horizontally directed longitudinal movement, whilst by means of the connecting rod 85 a roughly vertically directed movement is superimposed thereon and together give the movement path 82.

FIG. 8 shows a cutting device 93 and a pressure foot 94, which presses the material sloping from above against the serrated slat 81. This pressure foot is displaceable parallel to the needle axis 98 and is so pressed downwards by a spring 96, that its bow-shaped foot part 97 passing in fork-like manner around the needle is pressed downwards against the material. The pressure foot can be raised with a hand lever 98 and can be locked in the raised position when the subsequently described automatic cutting device is switched on and operating.

A clamping plate 100 engages around the pressure foot-guiding rod 88 and is pivotable about an axle 102 together with the lever 101 shown by broken line. Pivoting takes place by means of a leaf spring 103 fitted to the lever and pivot lever 101 counterclockwise during its tightening by an electromagnet 104. Whilst at its upper end the pressure foot 94 is guided in a sliding guide of its rod 99 in the base frame, it is substantially vertically movably guided at the bottom by means of a rocker arm 105.

Lever 101 has a downwardly extended arm 106, whose sloping end face can engage with the free end of a lever-like knife drive member 78, which is pivotably mounted about an axle 107 on the base frame and is articulated to a knife 108. The knife is located in a substantially vertically guided knife rod 109, on which acts a spring 110, which attempts to draw the knife into its upper end position.

The double cam-like crank web 53 can cooperate with the knife driving member 78, in order to drive the knife in oscillating manner with two strokes for each rotation of main shaft 48.

The knife has a sloping cutting edge 111 directed downwards counter to the material conveying direction 58 and at whose end a guide nose 112 extends downwards. It cooperates with a counterknife 113 (FIG. 10), the guide projection also maintaining the orientation of the knife in its upper position with respect to the counterknife 113 fitted to the material support table 83.

Figure 10:
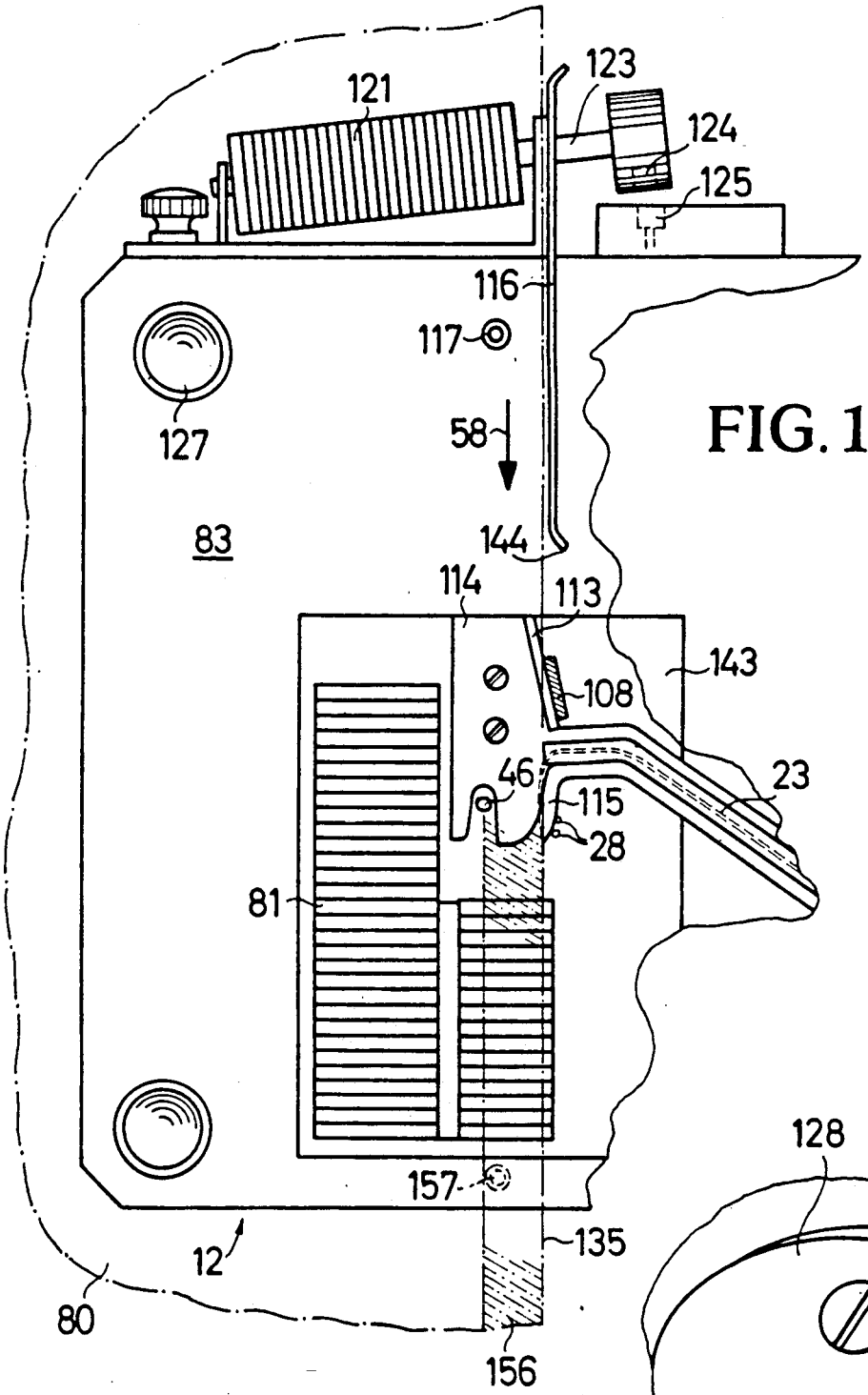
FIG. 10 a diagrammatic partial section roughly in the plane of the material support table.

FIG. 10 shows that the counterknife 113 is arranged on an interchangeable needle plate 114 inserted in material support table 83 and is arranged about a small angle in inclined manner to the material running direction 58. This takes account of the cutting conditions on cornering where the needles 46 determine the rotation axis.

FIG. 10 also shows that in the vicinity of the needles 46 is provided a guide nose 115 directed in the material running direction 58 and which guides the material edge and places the yarn 28 around it during the formation of an overcast loop, before during further conveying it slips therefrom and is fixed. If the intermediate ribbon 23 is used it is supplied between the material edge and guide nose 115.

A photosensor 117 is located in the material running direction in the support table spaced from the needle position and also from a pivotable away guide plate 116 for the material edge to be looped and said sensor can receive light from a lamp 118, FIG. 1, which constitutes the working light in the sewing area. The photosensor 117 belongs to a switching device, which contains a control mechanism in the electric control part 119 (FIG. 2) and by means of it can control the electromagnet 104 for operating the cutting mechanism and for raising the pressure foot (FIG. 8). By means of a switch 120 FIG. 2, the automatic cutting mechanism can be chosen or manual disconnection can take place.

An inlet roll 121 is fitted to the pivotable guide plate 116 and which, prior to the start of the material support table 83 is located with its upper edge above its plane and whose axis is inclined in such a way that an object moving thereon can be moved under a small angle against guide plate 160, particularly if the also pivotable pressure roller 122 resiliently presses the interposed material onto roll 121. The sloping spindle 123 of inlet roll 121 continues as a rotary shaft on the back of guide plate 116 and carries there a pulse generator, which contains a permanent magnet 124 (FIG. 10). The latter cooperates with a contact-free pulse receiver 125 on the base part and therefore supplies a counting pulse for each material advance corresponding to the circumference of the inlet roll. The result of this length count can be read off by means of a display 126 (FIG. 2) and can e.g. be used as a basis for cost calculations. Ball bearings 127 facilitate the material movement on table 183.

Figure 11:
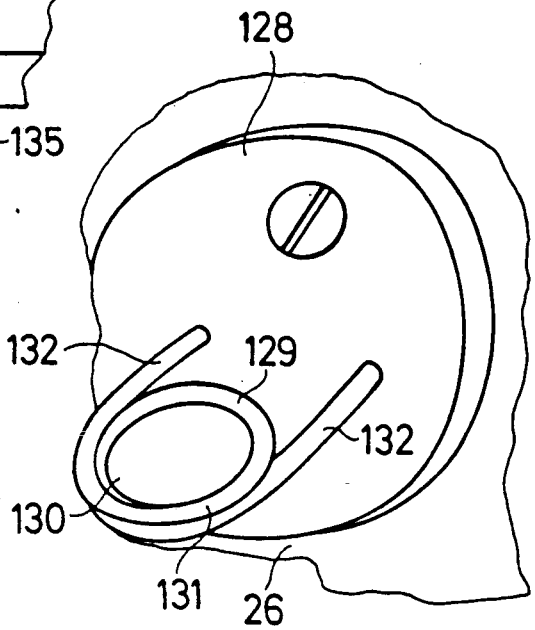
FIG. 11 a perspective view of a thread guide eyelet.

FIG. 11 shows a thread guide eyelet 32 on casing 26. The eyelets 30 on the thread unwinding frame 31 have basically the same construction. Eyelet 32 comprises a loop of bare, smooth wire 129, whose two ends are fitted to base plate 128. The opening 130 of the eyelet is bounded by a ring boundary 131, which comprises one and a half spiral wire windings, which are closely juxtaposed and therefore prevent any jamming of the thread between them. To the ring boundary 131 are connected two connecting legs 132, which connect the ring boundary 131 to baseplate 128. These two legs have with their outer faces a spacing which is at least as large as the maximum width of ring boundary 131. They can be parallel to one another or can optionally diverge somewhat from the ring boundary to the baseplate.

This eyelet prevents any loose thread being placed in loop form around the connecting section and then being tightened by squeezing of the superimposed yarn portions, which could lead to thread break. With this eyelet construction the thread always automatically slips away over the ring boundary if tension is exerted thereon.

The sewing machine according to the invention functions as follows. After the sewing machine has e.g. been transported to a building site, it is set up in the position shown in FIG. 2 by flipping down the support disk 19 and when locked in this way, yarn and twist bobbins 21, 25 can be mounted and the threads 28, 29 threaded. The course of the twist has already been described. For threading the yarn 28, through a threading channel 133, which passes along the base part 12 in an extension of the yarn guide channel 47, a threading tool 158, FIG. 1, in the form of a wire with a hook at its front is inserted. As the opening of the threading channel 133 is aligned with the opening of the yarn guide channel 47 and the eyelet 69 in the yarn gripper 65, when the machine is in the position marked on a handwheel 49, the threading tool 158 can be passed through until it projects out of the outer opening 134 of channel 47. The yarn, which can comprise several individual yarns, can then be hung in the hook and in one pull can be drawn through the yarn guide channel, the eyelet 69 and the threading channel 133. After being removed from the hook, the machine is ready to operate.

The material 80 to be looped or linked is then placed on the material support table 83 starting from the left in FIG. 1. The pressure roll 122 can be swung up in the case of a large material portion. The machine can be set up in stationary manner, e.g. on a table. However, advantageously, running on its runners 16, 17, it is advantageously moved along the laid out material, which only has to be cambered relatively little in order to pass onto the material support table 83, because base part 12 can be relatively flat due to the described sewing mechanism construction. Inlet roll 121 and ball bearings 127 also ensure easy running. A handle 138, FIG. 1, can be fitted by means of a locking fastening 153 on casing 26 and can be connected by means of an electric plug-in connection to sewing machine 11. It can also be fitted to an extension handle 152 shown in broken line form in FIG. 1 and which in turn can be locked on the locking fastening 153, which facilitates guidance of the machine on the ground.

Figures 4, 5, 6:
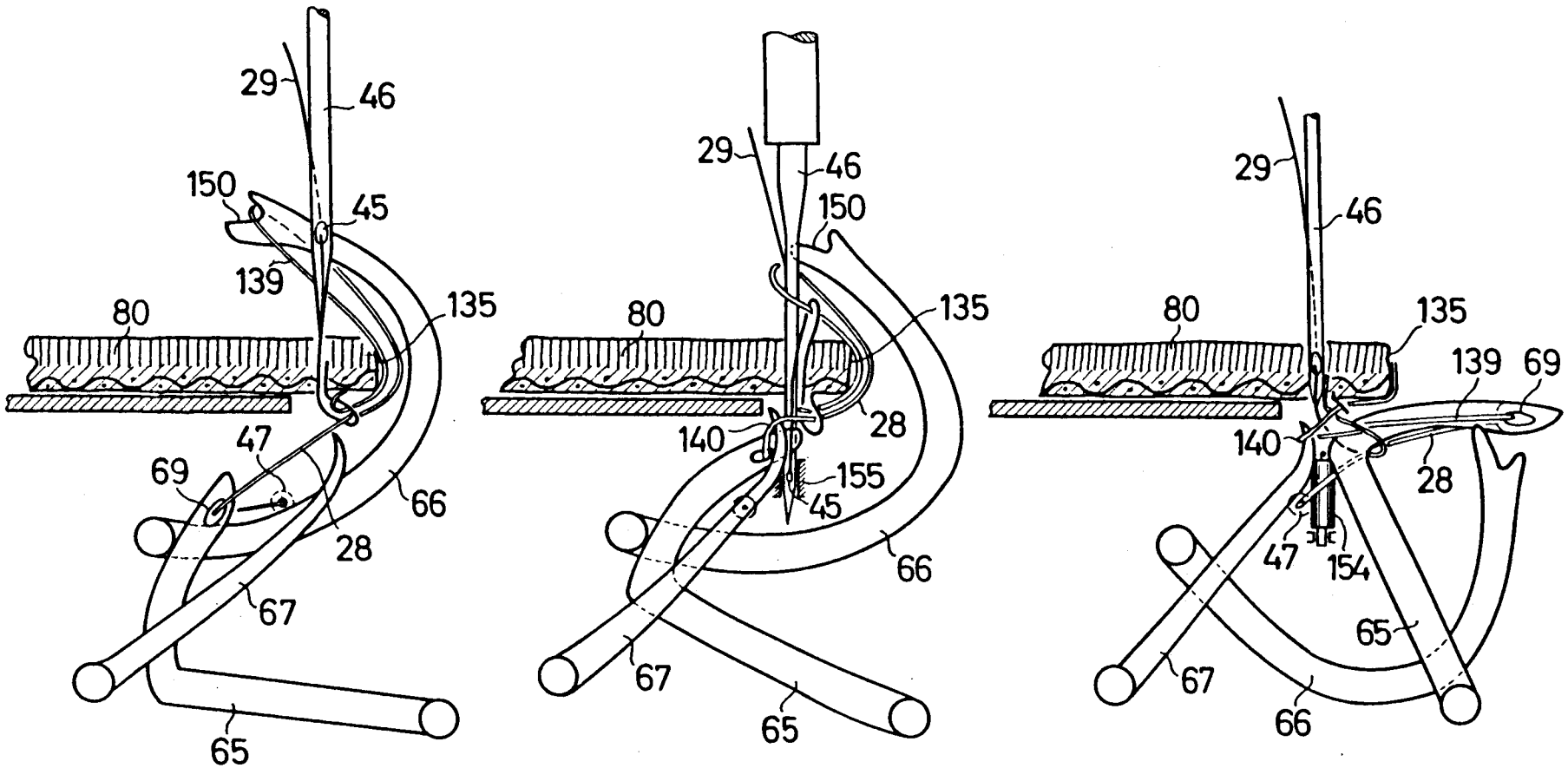
FIGS 4 to 6 three working positions of the sewing mechanism.

The edge 135, FIG. 4 to be looped of material 180 runs along the guide plate 116 and is guided under the foot clip 97 of pressure foot 94, which for this purpose is placed in an upper position by means of a raising lever 98. The pressure foot is then lowered and presses the underside of material onto the conveying serrated slat 81.

After switching on the main switch 136 (FIG. 2), the machine is then grasped on the transportation handle 138 and is put into operation by a switch 139 located therein. Conveying of material 80 described relative to FIG. 9 is consequently started up and the material is conveyed in direction 58 or the machine is drawn in the corresponding direction along the material edge. The conveying length per stroke, i.e. the stitch length, can be adjusted by means of the setting knob 89, which moves the threaded bush 87, on which the connecting rod 84 engages, on the threaded rod 88 and consequently determines the pivoting angle of lever 86 and consequently the longitudinal displacement of rod 91 and serrated slat 81.

Seam formation will be described relative to FIGS. 4 to 6. In FIG. 4 the overcast gripper 66 with its gripper fork 150 has passed a yarn overcast loop 139 around material edge 135 and brought it into a position on the other side of needle 46, so that the latter can perforate loop 139. The overcast gripper 66 then engages behind the needle, which perforates the loop, i.e. behind the front loop yarn, whilst the twist remains outside the loop, i.e. moves past in front of the yarn. This relates to the representation of FIGS. 4 to 6, in which the conveying direction of the material (arrow 58) is towards the viewer.

It can also be seen in FIG. 4 that the yarn 28 coming out of the yarn guide channel 47 passes through the eyelet 69 of yarn gripper 65 and draws it along by pivoting counterclockwise. In FIG. 5 the overcast gripper 66 has released the overcast loop 139, the needle has perforated the material and consequently a twist loop has been formed on the top around an arm of the overcast loop.

The now clockwise pivoted yarn gripper 65, pivots eyelet 69 past above the needle eye 45 between the needle and the twist and draws, as is particularly shown in FIG. 6, the yarn through a lower twist loop for forming the overcast loop. A yarn guide roller 154 connected to the opening of the yarn guide channel 47 and shown in FIG. 6 facilitates the tightening of the yarn length. Thus, the overcast loop 139 is formed between the yarn feed over the yarn guide channel 47 and a yarn portion connected to the final overcast loop. The retaining gripper 67 engages in this area and prevents the yarn portion (retaining loop 140) from being drawn too far in the direction of edge 135 during the formation of the overcast seam. Thus, in this position the lower twist loop 141 is not yet tightened and consequently the twist would not be located in the vicinity of the stitch row, but somewhere between the latter and edge 35.

FIG. 6 shows that after its complete pivoting back the overcast gripper 66 runs upwards again and engages in the overcast loop and places it around the edge 135, whilst the yarn gripper 65 is pivoted back into the position shown in FIG. 4 and the needle passes upwards. A needle guide 155 below the needle plate indicated in FIG. 5 prevents any bending of the needle during the tightening of the stitch.

Figure 7:
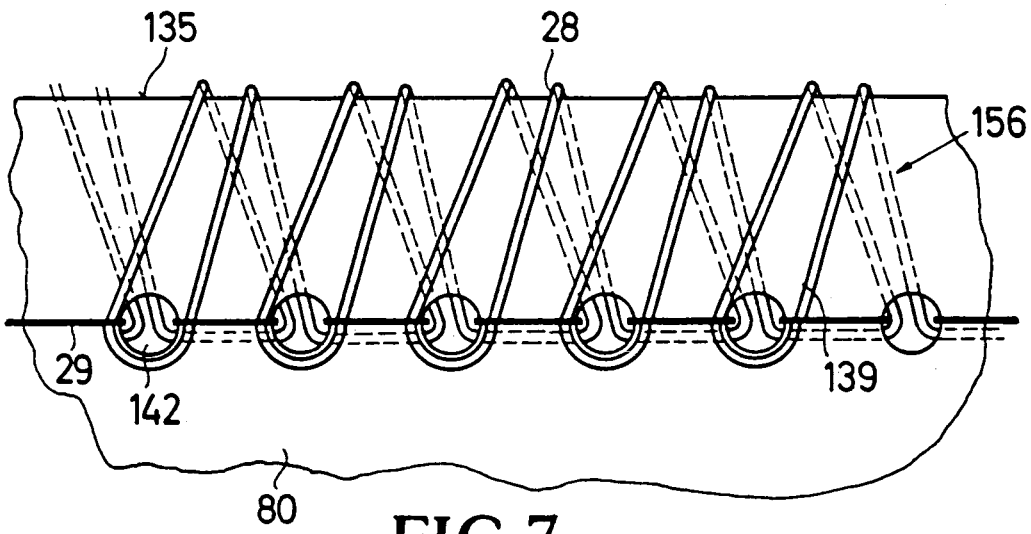
FIG. 7 the stitch diagram showing the thread path of looping performed with the sewing machine.

The two-thread overcast seam 156 shown in FIG. 7 is produced with this sewing mechanism and ensures great durability, accompanied by limited consumption of the relatively expensive twist. It can be seen that for every stitch 142 two yarn loops are placed round edge 135, whilst in plan view the twist 29 passes linearly from stitch to stitch and retains the yarn loops. Thus, it is possible to use a decorative, relatively bulky, but still inexpensive yarn, because it is only slightly loaded during the sewing process and twist 29 performs the retaining function. It has already been mentioned that the terms "yarn" and "twist" are used here only for distinguishing the two thread functions. Thus, the twist can be constituted by any adequately strong thread type, e.g. a monofilament plastic thread, which also applies with respect to the term "yarn".

It is also pointed out that the overcast loop 139 is not drawn directly around edge 135, but instead round the guide nose 115 (FIG. 10), from which it slides prior to the tightening of the overcast loop. If desired, the intermediate ribbon 23, covering edge 135 runs between material edge 135 and guide nose 15, so as to prevent e.g. in the case of very long pile carpets that pile parts project between the yarn loops. As a result of the excellent seam formation qualities and the large adjustment range of the stitch lengths it is also possible to work with a decorative intermediate ribbon, e.g. with a monofilament, transparent yarn looping need only take place with a relatively large stitch spacing.

As a result of the described arrangement, the thread feed takes place very uniformly and without any risk of overtensioning. The additional upwardly produced twist in the threads by the bobbin unwinding is compensated by the thread tightener and the yarn or twist is given no additional twisting effect on the feed side, which could take place with plate thread tighteners due to the helical configuration of yarn carding. The tension compensating spring 42, together with the thread raiser, ensures a uniform passage of the yarn through the thread tightener. However, with respect to the sewing machine the twist tension need not be high, because through the retaining gripper 67 the retention of the lower yarn loop in the stitch area need not be brought about by means of high twist tension. Thus, there is a significant reduction in the twist breaking risk.

On approaching a material corner the photosensor 117 previously covered by the material 80 is freed and receives light from lamp 118. Thus, the switching device is triggered and the previously currentless magnet 104 is activated. It swings the leaf spring 103 in the counterclockwise direction, so that lever 101 is also pivoted in this direction (FIG. 8). Thus, clamping plate 100 with the edges of its hole are pressed against the pressure foot rod 99 and thus secures the latter in such a way that it can only move upwards, but not downwards. Since during the conveying through the conveying serrated slat 81 the material and therefore the pressure foot is periodically raised and lowered, the foot is now only moved upwards and then remains in the upper position. It still has contact pressure in the upper conveying position, but frees the material during the lowering of the serrated slat 81, so that it can be turned relative to the sewing machine 11 or vice versa. Simultaneously the lower lever arm 106 pivots to the right so that the arm of the knife drive member 78 previously engaging thereon becomes free and consequently knife 108 and knife rod 109 is pressed against member 53 under the tension of spring 110 and can be moved in oscillating manner by it. Thus, the knife operates and cuts with its sloping cutting edge 111 in conjunction with the counteredge 113 an e.g. previously sharply right-angled material corner in a not too large, but uniform radius. The resulting waste can be removed through a waste channel 143 (FIGS. 1 and 10) in base part 12.

The cutting radius is determined in that the guide plate 116 with its edge 144 pointing in the conveying direction 58 is at a distance from the sewing area and in particular the needle position. Only when the material corner has passed said edge 144, can the material be rotated relative to the machine. The rounding is then immediately linked. When rounding is ended, the material again covers the photosensor 117 and the switching device makes magnet 104 currentless. Thus, lever 101 is loaded in the sense of a clockwise rotation, clamping plate 100 releases the pressure foot rod 99 and the knife drive member 78 slides along arm 106 during its pivoting movement and engages shortly prior to the dead centre below said lever and is consequently blocked. As a result of the bevel of the lower surface of arm 106 shown in FIG. 8 the knife drive member operates in a position where it can no longer be moved by member 53. Thus, the knife is blocked in its lower position, so that the cutting edge is covered.

It is possible to provide an additional photosensor 157 (FIG. 10) at a slight distance from the normal path of edge 135 behind the stitching position and is connected in series with sensor 117. In this case the knife would only start in the case of rotation of the cornering material on table 83 and not when the material is ended, e.g. in the case of strip looping. However, this is not prejudicial, because the knife works outside the path of edge 135.

I claim:

1. A sewing machine for edging a material comprising:

a machine frame provided with a drive motor;

a sewing mechanism coupled to said motor including a straight needle;

conveying means for conveying said material relative to the sewing mechanism, a holder for supplying at least one binding thread introduced via said straight needle from above;

means for forming a loop of said thread, a cutting device for cutting the material including a relatively fixed counterknife, a drivable knife mounted for movement in an oscillating manner, upstream of a path of movement of said needle mechanism and engageable with said counterknife, knife drive means for driving said knife, a switching device for switching said knife drive means on and off during operation of said straight need, a sensor for sensing the presence or absence of said material for automatically controlling said switching device and said sensor being positioned in a base part of said sewing machine forming a material support table for said material.

2. The sewing machine according to claim 1, wherein said switching device includes a locking mechanism for selectively locking said knife drive means in a first position decoupled from said oscillating knife drive means and in a second release position coupled to said drive means for effecting oscillation of said drivable knife.

3. The sewing machine according to claim 1, wherein said conveying means includes a conveying member engageable with said material, and said machine further comprises a raisable pressure foot pressing said material against said conveying member, means for relieving said pressure foot from said material, and means responsive to operation of said switching device for looping thread around corners of said material and for simultaneously cutting the thread thereof accompanied by relief of the pressure exerted by the raisable pressure foot on said material.

4. A sewing machine according to claim 3, further comprising means for oscillating said conveying member parallel to the direction of movement of said material, wherein said pressure relieving means includes means for fixing the pressure foot in a pressing position dependent on material thickness, and further including a clamping device operable by said switching device and acting in one direction for holding the pressure foot in a raised position, said pressure foot being raised to said raised position by a component of movement of said oscillating conveying member acting in a direction in which the pressure foot is guided and being accompanied by interposing of said material.

5. A sewing machine according to claim 1, wherein an inlet roller is provided on said support table upstream of said oscillating needle in terms of said material running direction, an associated pressure roller operatively positioned with respect to said inlet roller and engageable with said material during movement over the periphery of said inlet roller, said inlet roller having a shaft sloping such that said inlet roller imparts, to the material, a force having a component directing the edge of the material to be looped toward a guide stop, and wherein the circumference of the pressure roller is aligned with the top of the material support table formed by said base part.

6. A sewing machine according to claim 5, wherein a counting device operatively connected to said inlet roller provides electrical pulses responsive to rotation of said inlet roller in a contact-fee manner, and wherein the inlet roller is fitted to said guide stop, and wherein said machine further comprises means for moving said inlet roller and said guide stop jointly on said base.

7. A sewing machine for edging a material comprising: a machine frame provided with a drive motor, a sewing mechanism mounted on a base and including a straight needle, conveying means for conveying the material relative to the sewing mechanism and said needle, said frame including a holder for a supply of at least one thread introduced via said straight needle from a point above said needle, and means for forming a loop of said at least one thread, said loop forming means comprising: a guide stop operatively engaging an edge of said material upstream of the movement path of said needle, a cutting device for cutting said material, said cutting having a cutting action plane substantially aligned with said needle movement path but terminating at a distance therefrom, and means for supporting said guide stop for movement away from said material edge for facilitating looping inner rounded corners of the material.

8. A sewing machine for edging a material comprising: a machine frame provided with a drive motor; a sewing mechanism including a straight needle, conveying means for conveying said material relative to said sewing mechanism, a holder for the supply of at least one binding thread introduced via the straight needle from a point above said needle; and means for forming a loop of at least one thread, said loop forming means comprising an inlet roller provided on a base part at a position upstream, in the material running direction of said material, of said sewing mechanism, said inlet roller including a shaft sloping such that sad roller imparts, to the material, a force having a component directing an edge of the material to be looped towards a guide stop such that the circumference of the roller is aligned with a material support table defined by the top of the base part supporting said inlet roller for contact with said material movable towards said sewing mechanism by said conveying means.

9. A sewing machine according to claim 8, further comprising a counting device connected to said inlet roller and providing electrical pulses in response to rotation of said roller about an axis thereof in contact with said material and operating in a contact-free manner, said inlet roller being fitted to the guide stop, and means for pivotally mounting said guide stop for jointly pivoting said guide stop and said inlet roller relative to said base part.

10. A sewing machine for edging a material having an upper and lower surface comprising: a machine frame provided with a drive motor; a sewing mechanism operatively coupled to said drive motor and including a straight needle; a machine frame provided with a holder for the supply of at least one binding thread introduced via the straight needle from a point above said needle; conveying means for conveying said material relative to said sewing mechanism and said straight needle, and means for forming a loop of at least one thread, the sewing mechanism including means for forming a two-thread overcast seam including a retaining gripper for holding back a thread loop received from below the material during formation of an overcast loop, the retaining gripper being mounted for engaging said thread loop in the vicinity of the path movement of the needle and near the material lower surface into a thread emanating from a yarn gripper, thereby holding the thread loop close to the lower surface of the material.

11. A sewing machine according to claim 10 wherein a first thread is threaded into said needle, and a second thread is threaded into said yarn gripper, said machine further comprises an overcast gripper which grips and supports the thread from the yarn gripper and forms an overcase loop wherein the needle projects during oscillation of the needle.

12. A sewing machine according to claim 10, wherein said retaining gripper, said yarn gripper and said overcast gripper each have one end thereof supported by an axle for oscillation thereabout, and said machine further comprises means for driving said yarn and overcast grippers in harmonic and substantially continuous movement.

13. A sewing machine according to claim 10, further comprising self-guiding rolls for facilitating movement of said sewing machine relative to said material, and said machine includes a material supply part for supporting at least one bobbin and means for mounting said material supply part for flipping said part up and connecting said part to another of said sewing machine.

14. A sewing machine for edging a material comprising: a machine frame provided with a drive motor; a sewing mechanism including a straight needle; conveying means for conveying said material relative to the sewing mechanism and said vertically guided straight needle, a holder for the supply of at least one binding thread introduced via the straight needle from a point above said needle, and means for forming a loop of said at least one thread, said loop forming means comprising: a threading device for threading the thread in an eyelet of a yarn gripper located in a base part of said machine, said base part having a yarn guide channel having an outlet to one side of the eyelet, said sewing mechanism being positioned upstream, in a direction of movement of said material, from said eyelet and aligned with the opening of a threading channel located on the other side of said eyelet from said sewing mechanism such that a threading tool is guided through said threading channel, through said eyelet and through said yarn guide channel.

15. A sewing machine for edging a material comprising: a machine frame provided with a drive motor; a sewing mechanism connected to said drive motor and including a straight needle; a conveying means for conveying the material relative to the sewing mechanism; a thread supply for supplying at least one thread to the straight needle from a point above said needle and means for forming a loop of said at least one thread, the improvement wherein said thread supply means includes at least one thread tensioner guiding the thread between two faces, one face of which is movable, and wherein the thread supply means further comprises pressure means for creating a pressing force acting between the faces and means for providing said force dependent on thread tension, such that thread tension is automatically adjusted.

16. A sewing machine according to claim 15, wherein said thread tensioner includes a roll rotatable about an axis of said roll, said roll having a circumferential surface for guiding said at least one thread and a pressure part having a shape corresponding to the circumferential surface of said rotatable roll and being pressed against said circumferential surface and including means for adjusting the spring tension of said pressure part.

17. A sewing machine for edging a material comprising: a machine frame provided with a drive motor, a sewing mechanism operatively coupled to said drive motor and including a straight needle; conveying means for conveying said material relative to the sewing mechanism, a thread supply for supplying at least one thread to said needle, and means for forming a loop of said at least one thread, and said thread supply means comprising; at least one eyelet having a thread receiving opening defined by a ring boundary having connection means connecting the ring boundary to the sewing machine frame, said connection means having a width at least equal to the overall external width of the ring boundary.

18. A sewing machine according to claim 17, wherein said ring boundary comprises a wire ring of approximately 1½ loops of closely juxtaposed windings and a pair of substantially parallel connecting legs fixed at one end to said wire ring and at another end to said sewing machine frame.

* * * * *